US006234364B1

(12) United States Patent
Nybakke et al.

(10) Patent No.: US 6,234,364 B1
(45) Date of Patent: May 22, 2001

(54) PASSENGER BEVERAGE SERVER

(75) Inventors: Keith G. Nybakke, Minneapolis; Greg A. Loffler, Prior Lake, both of MN (US)

(73) Assignee: Service Ideas, Inc., Woodbury, MN (US)

( * ) Notice: Subject to any disclaimer, the term of this patent is extended or adjusted under 35 U.S.C. 154(b) by 0 days.

(21) Appl. No.: 09/311,440

(22) Filed: May 14, 1999

(51) Int. Cl.[7] ..... A47G 19/14

(52) U.S. Cl. ..... 222/469; 222/470; 222/475.1; 222/516

(58) Field of Search ..... 222/465.1, 469, 222/470, 475.1, 516, 555

(56) References Cited

U.S. PATENT DOCUMENTS 4,921,146 * 5/1990 Salzmann ..... 222/470
5,273,194 * 12/1993 McNamara ..... 222/470
5,497,917 * 3/1996 Krimmel et al. ..... 222/475.1
5,653,362 * 8/1997 Patel ..... 222/475.1
5,988,457 * 11/1999 Andrew et al. ..... 222/475.1

* cited by examiner

*Primary Examiner*—Joseph A. Kaufman
(74) *Attorney, Agent, or Firm*—Moore & Hansen

(57) ABSTRACT

The present invention is a spill-resistant beverage server ideally suited for pouring beverages aboard airliners in flight. The server utilizes a plurality of small pour openings and a closed top which prevents accidental spillage in the event of rough flying conditions. A thumb actuator lever opens the pour openings when in use and a closing device closes the pour openings when the thumb actuator is released. The server is shaped to provide a low center of gravity, even when the container is full, thereby providing a stable server resistant to tipping. A rubber coating over the handle gives the operator a positive grip and prevents accidental dropping. The server also incorporates an indicator device used to display the type of beverage contained therein.

18 Claims, 3 Drawing Sheets

88
84
80
86
82
2
60
66
63
62
74
68
78
50
56
51
12
66
65
56
4
2
52
46
55a
55b
10
38
54
36
37
56
34
35
46
30
58
40
24b
46
46
40
44
29
42
26
14
32
32
20
4
24a
22
28
16
18

PASSENGER BEVERAGE SERVER

BACKGROUND OF THE INVENTION

This invention relates generally to a beverage server ideally suited for airline service. More particularly, the present invention relates to a beverage server with a plurality of small pour openings designed to provide a steady, controlled flow when poured and to resist sudden surges of liquid if the container is bumped or jerked. The server has a thumb actuator which can be moved to uncover the pour openings and allow a liquid to be poured. The thumb actuator is biased to return to a closed position when released. The container is shaped to retain a low center of gravity regardless of the quantity of liquid contained therein.

Pouring beverages during a flight presents unique problems. Aircraft often encounter areas of varying air pressure which act on the plane to produce abrupt elevation changes. These pressure differences or turbulence result in a bumpy ride for the passengers of the airplane and makes it difficult to pour beverages such as coffee and tea which are not typically packaged in individual containers. Furthermore, turbulence can act to tip over containers that are simply resting on a service cart.

BRIEF SUMMARY OF THE INVENTION

It is a primary object of this invention to provide a beverage server with a controlled flow rate.

It is another object to provide a beverage server that remains closed when not in use.

It is a further object to provide a beverage server that is stable and resistant to tipping or spilling.

It is another object to provide a beverage server that provides an indicator which indicates the type of beverage contained therein.

The instant invention comprises a beverage server with a plurality of small pour openings which provide a substantially constant flow regardless of whether the container is bumped or jerked while the liquid is being poured. A moveable closing device keeps the pour openings closed when the server is not in use.

As a further beneficial feature, the server is relatively squat to resist tipping and preferably has a rubber coating over the handle to provide the operator with a positive grip.

The closing device may preferably comprise a rotatable ring with a thumb actuator and a plurality of closing elements which are substantially diametrically opposed to the thumb actuator in cooperative juxtaposition to the pour openings. A biasing mechanism, preferably clip springs, ensure that the closing elements cover the pour openings when the beverage server is not being used and the thumb actuator is in its rest or closed position. When the thumb actuator is rotated slightly in either direction, the closing elements are angularly displaced, uncovering the pour openings.

The closing device is advantageously mounted on the top wall of a container in which liquid is held. The aforesaid pour openings are defined by the top wall which also defines a large fill opening.

The container further comprises a handle opposite the pour openings which has a flange extending upwardly therefrom. The thumb actuator extends over the flange and has a hollow bottom side with a downwardly extending skirt which limits the angular distance that the actuator may be rotated by making contact with the flange.

In the disclosed embodiment, an annular cover attaches to the top of the container and covers the ring closing device.

Projections extending upwardly from the container and downwardly from the cover act together to provide a guide path within which the ring may rotate. The cover also defines a fill opening within which a lid may be removably received to form a watertight seal. Vent holes penetrate the top of the cover and provide a path for air to travel to replace the liquid being dispensed from the container and ensure a smooth pour. The cover and the container both have forwardly extending, vertically aligned lips which together form a pour spout adjacent the pour openings.

DESCRIPTION OF THE PREFERRED EMBODIMENTS

Figure 1:
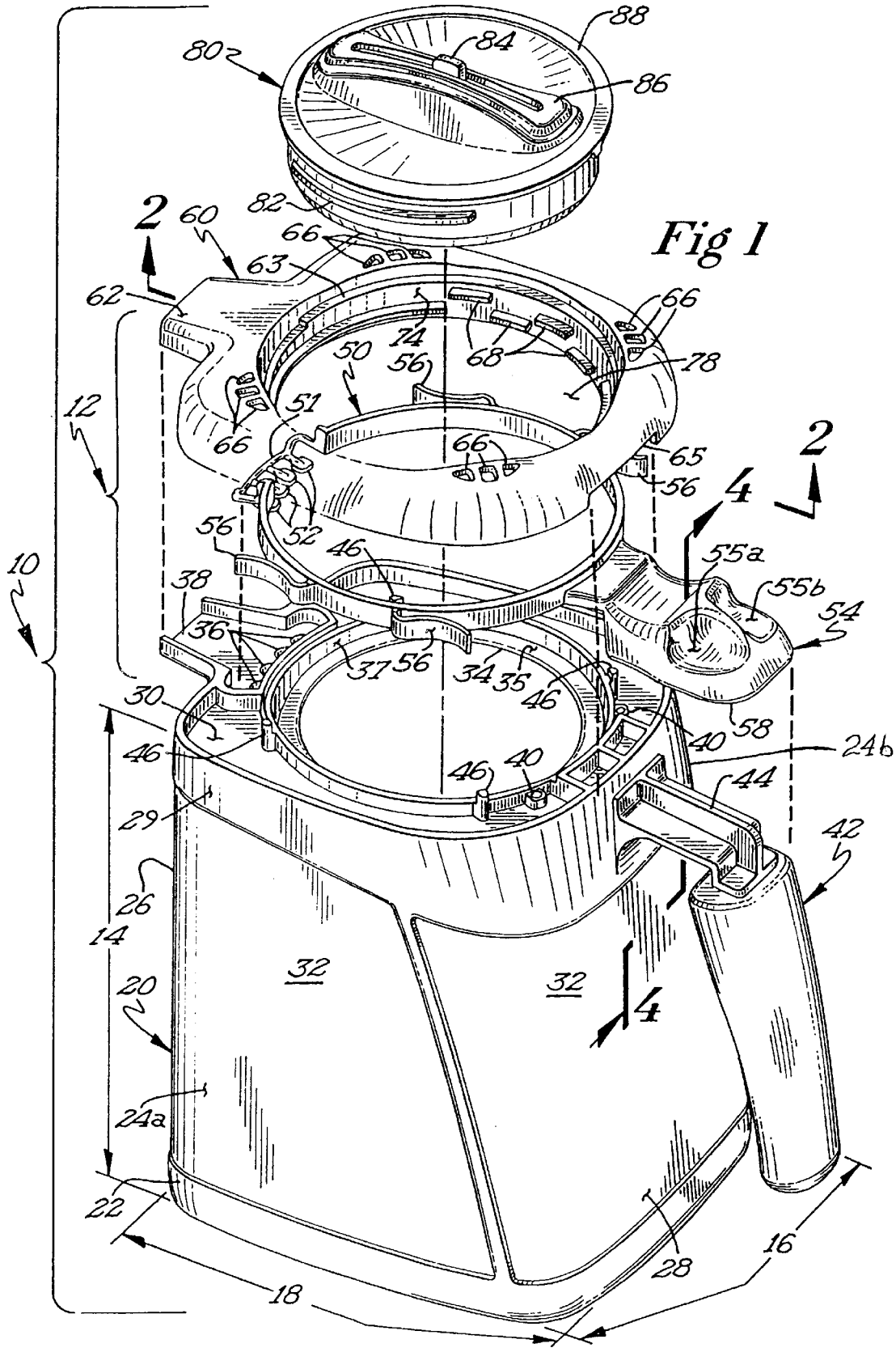
FIG. 1 is an exploded perspective view of the present invention.

With reference to the drawings, and first to FIG. 1, there is shown a beverage server 10 comprising a container 20, an actuator ring 50, a cover 60 and a lid 80. The beverage server is substantially spill proof and resistant to tipping due to its dimensions in terms of height 14, width 16, and length 18. Top and bottom 29 and 22 may define oblong top and bottom peripheral contours as shown. The top periphery 29 is of lesser width and length than periphery of bottom 22.

The container 20 has a bottom wall (not shown), sidewalls 24*a* and 24*b*, a front wall 26 (shown in FIG. 3), a back wall 28 and a top surface 30. Sidewalls 24*a*, 24*b*, and front and back walls 26 and 28, which are preferably formed as continuous wall 32, extend upwardly from the peripheral edge of bottom 22. The top periphery or peripheral edge surface 29 may preferably be of lesser length than length 18 of bottom 22, whereby back wall 28 is inclined downwardly and rearwardly from top to bottom. This construction defines a squatty, stable container with a low center of gravity.

A lower spout lip 38 protrudes outwardly from the wall 32 proximate the front 26, and is preferably molded integrally with container 20. The top wall 30 extends laterally inwardly from the top periphery 29 and forms an annular shoulder 3 5 defining central fill opening 34. At least one, and preferably a plurality of pour openings 36 extend through top wall 30 at the inner end of lower spout lip 38. The container 20 also has a plurality of projections 46 that extend upwardly from the top 30 on the outside surface of rim 37 to serve as assembly guides as hereinafter set forth. One or more air holes 40 that extend through the top 30 proximate the back 28 are also preferably provided.

A handle 42 extends outwardly and downwardly from the rear surface of top peripheral surface 29 proximate the back wall 28. The handle 42 includes a flange 44 extending upwardly therefrom. The handle 42 is preferably coated with a rubber covering as shown for soft, secure gripping. A vertically projecting wall or rim 37 projects upwardly from top wall 30 around the inner periphery of shoulder 35.

Figure 2:
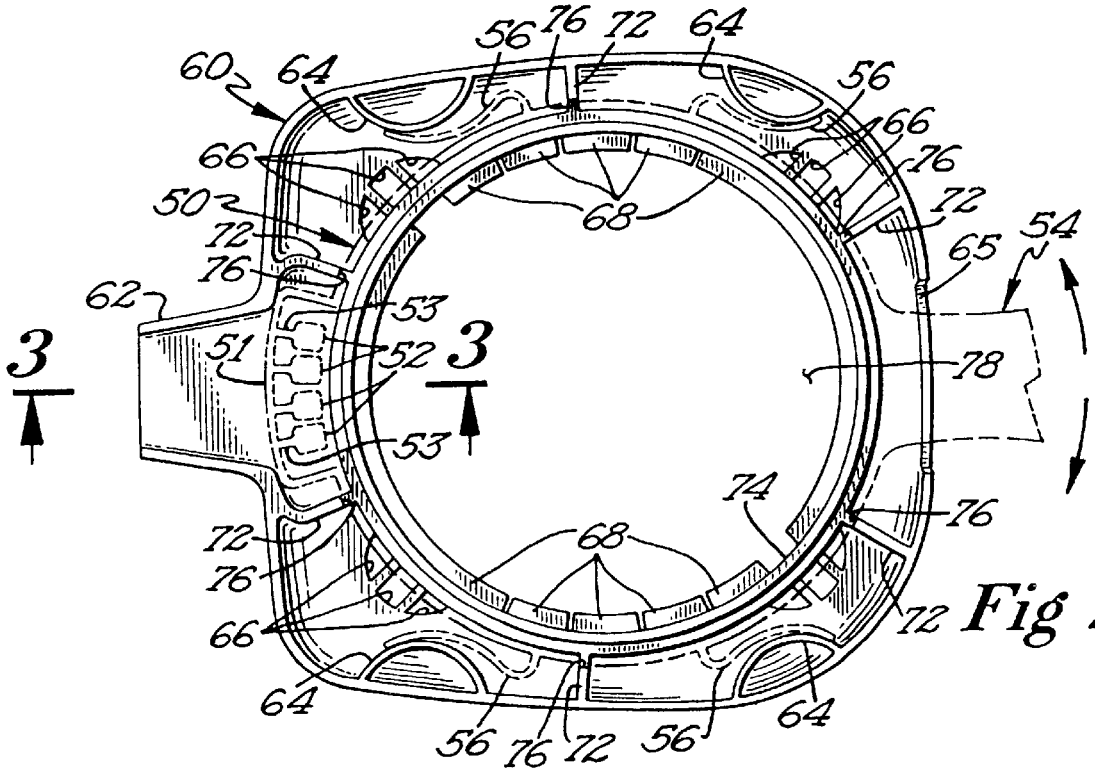
FIG. 2 is a bottom plan view of the top of the present invention, taken generally along lines 2—2 of FIG. 1.

Flow is controlled through the pour openings 36 by an actuator ring 50. The actuator ring 50 carries one, or preferably a plurality of valve elements 52, the number of which corresponds to the number of pour openings 36 in the top 30 of the container 20. As is indicated most clearly in FIGS. 1 and 3, the valve elements 52 are usually in a normal position over the pour openings 36, covering them and forming a watertight seal so that the liquid stored in the container 20 cannot pass through the pour openings accidentally. Formed integrally with actuator ring 50 is a wire-like bridge 51 having extension arms 53 projecting laterally inwardly therefrom and supporting valve elements 52 at their inner ends. A thumb actuator arm 54, preferably having both left-handed and right-handed thumb rest areas 55*a* and 55*b* extends rearwardly from the ring 50 proximate the back 28 such that it overhangs the handle 42. A skirt 58 extends downwardly from the thumb actuator 54 and covers the flange 44 of the handle 42. The ring 50 preferably has at least one pair of opposed clip springs 56 extending outwardly from its perimeter as shown in FIGS. 1 and 2.

The cover 60 is shaped in conforming relation to the top 30 of the container 20 and is attached thereto. The cover 60 has a cylindrical wall 74 which defines a circular fill hole 70 located directly above and substantially concentric with the fill opening 34 of the container 20. The cylindrical wall 74 preferably has thread elements 68 projecting inwardly therefrom. The cover 60 also has an upper lip 62 which projects outwardly proximate the front 26 of the container 20 and conforms to the lower lip 38 thereof The lower lip 38 abuts with the upper lip 62 to form a pour spout 12. The cover 60 further has downwardly extending cover projections 72 which align vertically with the container projections 46 to form a recessed guide path 76 in which the actuator ring 50 rests and rotates as most clearly shown in FIGS. 2 and 3. Preferably, curved posts 64 extend downwardly from inside the cover 60 to provide surfaces against which the clip springs 56 of the ring 50 act to return the ring 50 to the normal position such that the valve elements 52 cover the pour openings 36. An opening 65 is formed through the rear side of annular cover 60 for the extension of actuating arm 54 therethrough. Finally, the cover may have air vents 66 which provide a path for air to flow from outside the server 10, through the air vents 66, through the air holes 40, into the container 20.

Figure 3:
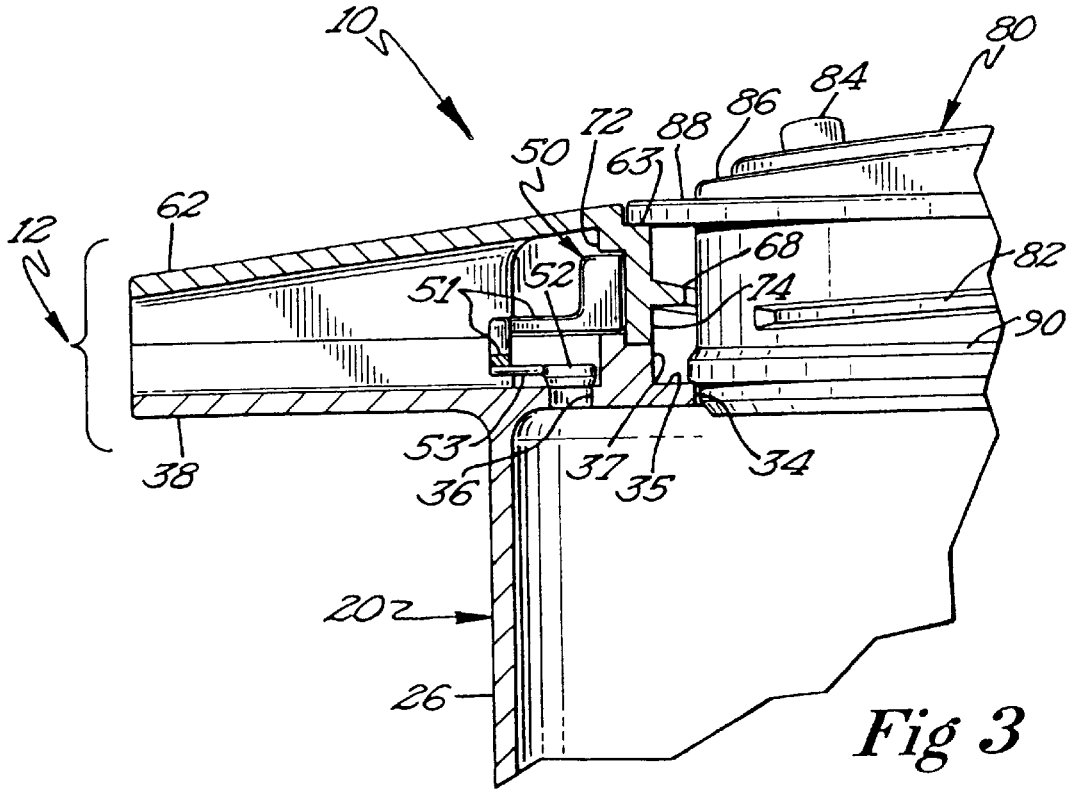
FIG. 3 is a partial, cut-away elevational view of the pour spout of the present invention, taken generally along lines 3—3 of FIG. 2, and showing the valve elements and wire-like bridge of the actuator ring.
Figure 4:
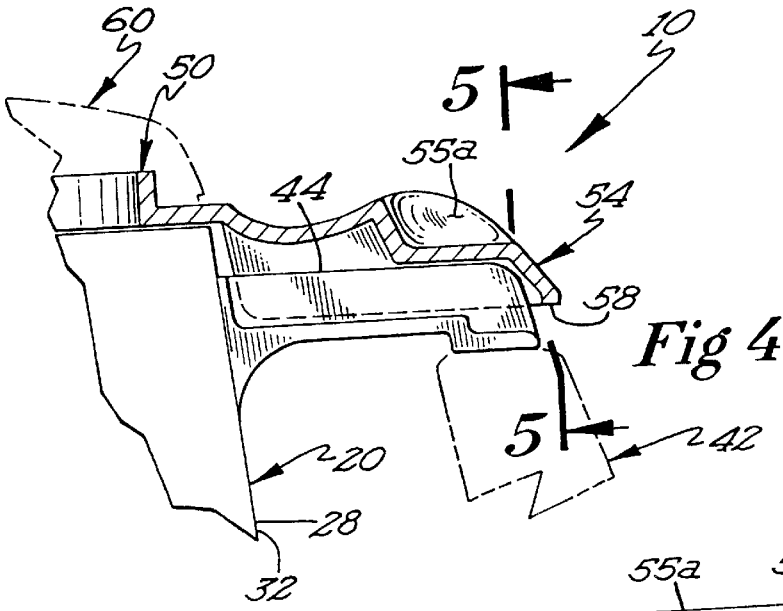
FIG. 4 is a partial, cut-away elevational view of the handle and actuator ring of the present invention, taken generally along lines 4—4 of FIG. 1.
Figure 5:
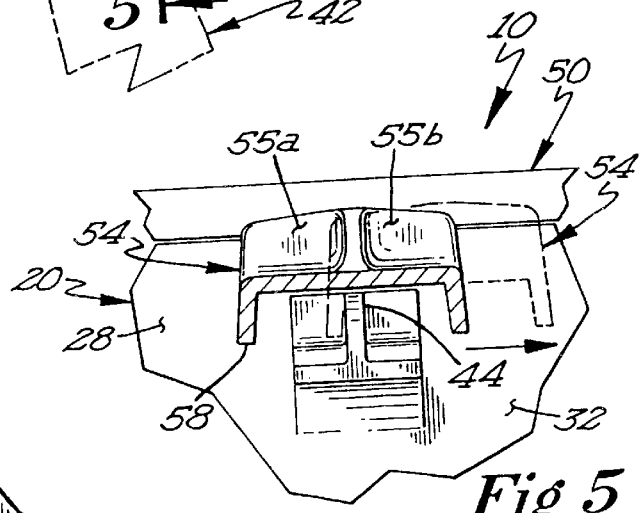
FIG. 5 is a partial, cut-away elevational view of the handle and actuator ring of the present invention, taken generally along lines 5—5 of FIG. 4, and showing the movement of the actuator ring.
Figure 6:
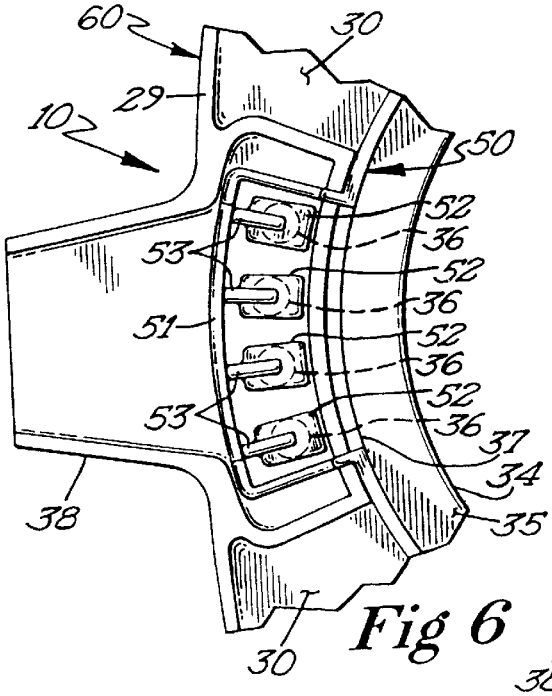
FIG. 6 is a top, cut-away view of the container of the present invention showing the valve elements of the actuator ring in a closed position covering the pour openings; and, FIG. 7 is a top, cut-away view of the container of the present invention showing the valve elements of the actuator ring in an open position, angularly displaced from the pour openings.
Figure 7:
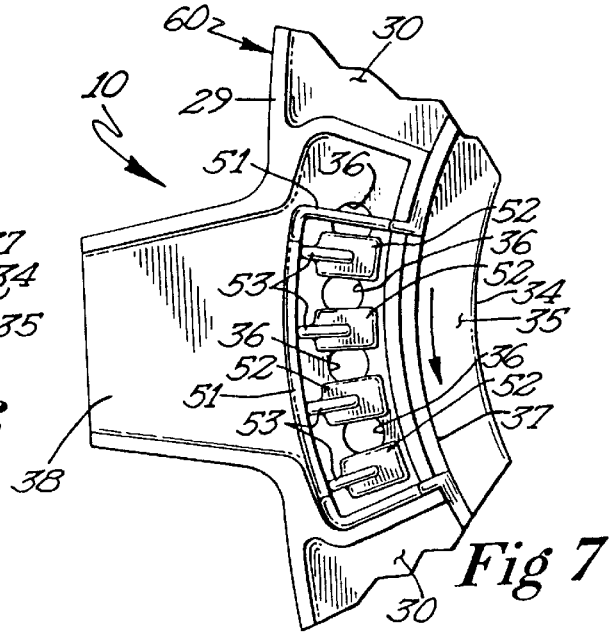

A lid 80 is used to close the fill hole 70 of the cover 60. The lid 80 is circular and forms a watertight seal with the cylindrical wall 74 of the cover 60 when placed therein. For that purpose, lid 80 is formed to include a peripheral top lip 88 which seats as shown in FIG. 3 on the shoulder 63 formed at the top of cylindrical wall 74. In a preferred embodiment, the lid 80 has threads 82 that mate with the threads 68 of the cover 60. The lid 80 may have a grip 86 extending upwardly therefrom to provide a place for an operator to grasp when removing or replacing the lid 80. When the lid is screwed into place as shown in FIG. 3, its top lip 88 is drawn down tight against shoulder 63, and its lower rim 90 abuts against shoulder 35 of container top wall 30. It is envisioned that an indicator flag 84 is slidably attached to the grip 86 such that the flag 84 has a plurality of positions, each signaling the type of beverage which is contained within the server 10.

In operation of the preferred embodiment, the operator grasps the handle 42 such that the operator's thumb rests on one of the thumb rest areas 55*a* or 55*b,* depending on which hand is used to lift the server 10. The operator then rotates the thumb actuator 54 in either a clockwise or counterclockwise direction, as indicated by the directional arrows in FIG. 2, until the actuator 54 is stopped by the skirt 58 abutting against the flange 44 of the handle 42. This action rotates the ring 50 the proper amount to optimally move the valve elements 52, uncovering the pour openings 36, and also compresses the clip springs 56 against the posts 64. The operator then tips the server 10 forward, allowing the liquid in the container 20 to flow through the pour openings 36, around the valve elements 52, and out the pour spout 12. As the liquid flows out of the container 20, air is sucked in through the air vents 66, then through the air holes 40, and into the container 20.

When the operator is finished, the thumb actuator 54 is released. The clip springs 56 expand against the posts 64 and cause the ring 50 to rotate back to its normal position such that the valve elements 52 cover the pour openings 36 and reestablish a watertight seal therebetween.

In order to ensure a stable server 10. The server 10 has dimensions which maintain a low center of gravity regardless of the quantity of liquid stored in the container 20. It is envisioned that the server be of any size. However, it is preferred that the height 14 be no more than fifty percent greater than the lesser dimension of width 16 and length 18.

What is claimed is:

1. A beverage server for containing a fluid, the beverage server comprising:

a container having a bottom, an outer wall extending upwardly from the bottom, and a top opposite the bottom and overhanging the bottom, the top defining a fill opening and at least one pour opening, the container having a handle extending from the outer wall and further having a lower lip extending outwardly from the outer wall proximate the pour opening;

an actuator ring rotatably engaged with the top of the container for movement between an open position and a closed position, the actuator ring having at least one valve element constructed and arranged to cover the at least one pour opening when the actuator ring is in the closed position in such a way that the valve element substantially restricts flow of the fluid through the pour opening the rotatable actuator ring further comprising at least one spring biased to maintain the ring in a position wherein the valve element covers the pour opening in the closed position, the spring being flexible enough to allow an operator to rotate the ring to an open position wherein the valve element is displaced from the pour opening and the spring is tensioned enough to return the ring to the closed position when the ring is released by the operator; and, a lid removably inserted into the fill opening of the top, forming a watertight seal between the lid and the top.

2. The server of claim 1 wherein the server further comprises an indicator for displaying the type of beverage contained within the server.

3. The server of claim 2 wherein the indicator comprises a flag slidably attached to the lid.

4. The server of claim 1 wherein the circular fill opening has threads.

5. The server of claim 4 wherein the lid has threads to mate with the threads of the top.

6. The server of claim 1 wherein the at least one spring comprises at least one clip spring extending outwardly from the ring and acting against at least one post extending downwardly from the cover such that when the ring is rotated, the clip spring is tensioned against the post and acts against the post to return the ring to the closed position when the ring is released by the operator.

7. The server of claim 6 wherein the at least one spring comprising the at least one clip spring extends downwardly from the cover and acts against the at least one protrusion which extends from the ring such that when the ring is rotated, the protrusion tensions the at least one clip spring which acts against the protrusion to return the ring to the closed position when the ring is released by the operator.

8. The server of claim 1 wherein the actuator ring further comprises a thumb actuator lever extending outwardly and rearwardly from the ring proximate the handle of the container.

9. The server of claim 1 wherein the top further comprises at least one vent opening extending through the top.

10. The server of claim 1 wherein the walls of the container are insulated.

11. The server of claim 1 wherein the container further comprises a rubber coating over the handle.

12. The server of claim 1 wherein the height dimension of the container is no more than 50% greater than the smaller of the length and width dimensions of the server.

13. The server of claim 1 wherein the actuator ring is rotatable in either direction in order to displace the valve elements from the pour openings.

14. The server of claim 1 wherein the container further comprises air holes defined by the top of the container.

15. The server of claim 1 wherein the container further comprises a cover with an upper lip and a circular fill opening, the cover shaped in conforming relation to the top of the container and attached thereto, the circular fill opening being defined by the cover and substantially concentric with the circular fill opening of the container, the upper lip extending outwardly from the cover and conforming to the lower lip of the container such that the lower lip and the upper lip form a pour spout.

16. The server of claim 15 further comprising a lid removably inserted into the fill opening of the cover, forming a watertight seal between the lid and the cover.

17. The server of claim 15 wherein the ring is sandwiched between the container top and the cover for rotatable guiding movement therebetween.

18. A beverage server for containing a fluid, the beverage server comprising:

a container having a bottom, an outer wall extending upwardly from the bottom, and a top opposite the bottom and overhanging the bottom, the top defining a flit opening and at least one pour opening, the container having a handle extending from the outer wall and further having a lower lip extending outwardly from the outer wall proximate the pour opening; and, an actuator ring rotatably engaged with the top of the container for movement between an open position and a closed position, the actuator ring having at least one valve element constructed and arranged to cover the at least one pour opening when the actuator ring is in the closed position in such a way that the valve element substantially restricts flow of the fluid through the pour opening;

the rotatable actuator ring further comprising at least one spring constructed and arranged to bias the actuator ring into a closed position wherein the valve element covers the pour opening, the at least one spring being flexible enough to allow an operator to rotate the actuator ring to an open position wherein the valve element is displaced from the pour opening, the spring being tensioned enough to return the actuator ring to the closed position when the actuator ring is released by the operator, the at least one spring comprising at least one clip spring extending outwardly from the actuator ring and acting against at least one post extending downwardly from the cover such that when the actuator ring is rotated, the clip spring is tensioned against the post and acts against the post to return the actuator ring to the closed position when the actuator ring is released by the operator.

* * * * *